US011557237B2

(12) United States Patent
Chen

(10) Patent No.: US 11,557,237 B2
(45) Date of Patent: Jan. 17, 2023

(54) OVERDRIVE METHOD AND CIRCUIT

(71) Applicant: HIMAX TECHNOLOGIES LIMITED, Tainan (TW)

(72) Inventor: Chiu-Yu Chen, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 10 days.

(21) Appl. No.: 17/107,897

(22) Filed: Nov. 30, 2020

(65) Prior Publication Data

US 2022/0172657 A1 Jun. 2, 2022

(51) Int. Cl.
*G09G 3/20* (2006.01)

(52) U.S. Cl.
CPC ..... *G09G 3/20* (2013.01); *G09G 2310/027* (2013.01); *G09G 2320/0285* (2013.01); *G09G 2360/16* (2013.01)

(58) Field of Classification Search
CPC combination set(s) only.
See application file for complete search history.

(56) References Cited

U.S. PATENT DOCUMENTS

2006/0152501 A1* 7/2006 Furihata ..... G09G 3/3648 345/204
2014/0071143 A1* 3/2014 Wang ..... H04N 19/186 345/98
2014/0210872 A1* 7/2014 Sasaki ..... G09G 3/3648 345/690
2021/0056915 A1* 2/2021 Holland ..... G09G 3/3233

* cited by examiner

*Primary Examiner* — Van N Chow
(74) *Attorney, Agent, or Firm* — CKC & Partners Co., LLC

(57) ABSTRACT

An overdrive method includes: performing loss compression to an input image to generate image data, and storing the image data into a memory; reading the image data from the memory and decoding the image data to obtain a previous image; obtaining a current image, calculating a difference between a current grey level at a location of the current image and a previous grey level of the previous image at the location; calculating a gain according to the difference and a threshold; calculating an overdrive grey level according to the current grey level and the previous grey level; and mixing the overdrive grey level and the current grey level based on the gain to generate an output grey level to replace the current grey level.

8 Claims, 4 Drawing Sheets

OVERDRIVE METHOD AND CIRCUIT

BACKGROUND

Field of Invention

The present disclosure relates to a progressive overdrive mechanism.

Description of Related Art

In a general liquid crystal display, an overdrive (OD) technology is often used to change a grey level of an image to shorten the response time of liquid crystal molecules. In some conventional approaches, a difference between a current grey level at a particular location of a current image and a grey level of a previous image at the same location is calculated. If the difference is greater than a threshold, then an OD adjustment is performed to change the current grey level, otherwise the current grey level remain unchanged. However, it would produce flicker if the differences in a motion video are alternatively greater than a threshold and smaller than the threshold. How to reduce the flicker is an issue concerned by people in the art.

SUMMARY

Embodiments of the present disclosure provide an overdrive method for a display panel. The overdrive method includes: performing loss compression to an input image to generate image data, and storing the image data into a memory; reading the image data from the memory and decoding the image data to obtain a previous image; obtaining a current image, calculating a difference between a current grey level at a location of the current image and a previous grey level of the previous image at the location; calculating an overdrive grey level according to the current grey level and the previous grey level; if the difference is less than a threshold, calculating a gain according to the difference and the threshold, and mixing the overdrive grey level and the current grey level based on the gain to generate an output grey level to replace the current grey level; if the difference greater than or equal to the threshold, outputting the overdrive grey level as the output grey level to replace the current grey level.

In some embodiments, the step of calculating the gain according to the difference and the threshold includes: calculating a ratio of the difference to the threshold; and inputting the ratio into a continuous and increasing function to obtain the gain.

In some embodiments, the continuous and increasing function is a polynomial function.

In some embodiments, the step of calculating the overdrive grey level according to the current grey level and the previous grey level includes: inputting the current grey level and the previous grey level to a lookup table to obtain the overdrive grey level.

In some embodiments, the step of mixing the overdrive grey level and the current grey level based on the gain to generate the output grey level is performed based on the following equation (1).

$$\text{output_value}=\text{current_value}+G\times(\text{OD_value}-\text{current_value}) \quad (1)$$

output_value is the output grey level, current_value is the current grey level, OD_value is the overdrive grey level, and G is the gain.

From another aspect, embodiments of the present disclosure provide an overdrive circuit including a memory, an encoding circuit, a decoding circuit, and an overdrive computation circuit. The encoding circuit is electrically connected to the memory and is configured to perform loss compression to an input image to generate image data, and to store the image data into the memory. The decoding circuit is electrically connected to the memory and is configured to read the image data from the memory and to decode the image data to obtain a previous image. The overdrive computation circuit is electrically connected to the decoding circuit and configured to obtain a current image, calculate a difference between a current grey level at a location of the current image and a previous grey level of the previous image at the location, and calculate an overdrive grey level according to the current grey level and the previous grey level. If the difference is less than a threshold, the overdrive computation circuit is configured to calculate a gain according to the difference and the threshold, and mix the overdrive grey level and the current grey level based on the gain to generate an output grey level to replace the current grey level. If the difference is greater than or equal to the threshold, the overdrive computation circuit is configured to output the overdrive grey level as the output grey level to replace the current grey level.

In some embodiments, the overdrive computation circuit is further configured to calculate a ratio of the difference to the threshold and input the ratio into a continuous and increasing function to obtain the gain.

In some embodiments, the overdrive computation circuit is further configured to input the current grey level and the previous grey level to a lookup table to obtain the overdrive grey level.

In some embodiments, the overdrive computation circuit is configured to generate the output grey level based on the said equation (1).

BRIEF DESCRIPTION OF THE DRAWINGS

The disclosure can be more fully understood by reading the following detailed description of the embodiment, with reference made to the accompanying drawings as follows.

DETAILED DESCRIPTION

Specific embodiments of the present disclosure are further described in detail below with reference to the accompanying drawings, however, the embodiments described are not intended to limit the present disclosure and it is not intended for the description of operation to limit the order of implementation. Moreover, any device with equivalent functions that is produced from a structure formed by a recombination of elements shall fall within the scope of the present disclosure. Additionally, the drawings are only illustrative and are not drawn to actual size.

In addition, the term "electrically connected" used in the specification should be understood for electrically connecting two units directly or indirectly. In other words, when "a first object is electrically connected to a second object" is written in the specification, it means another object may be disposed between the first object and the second object.

Figure 1:
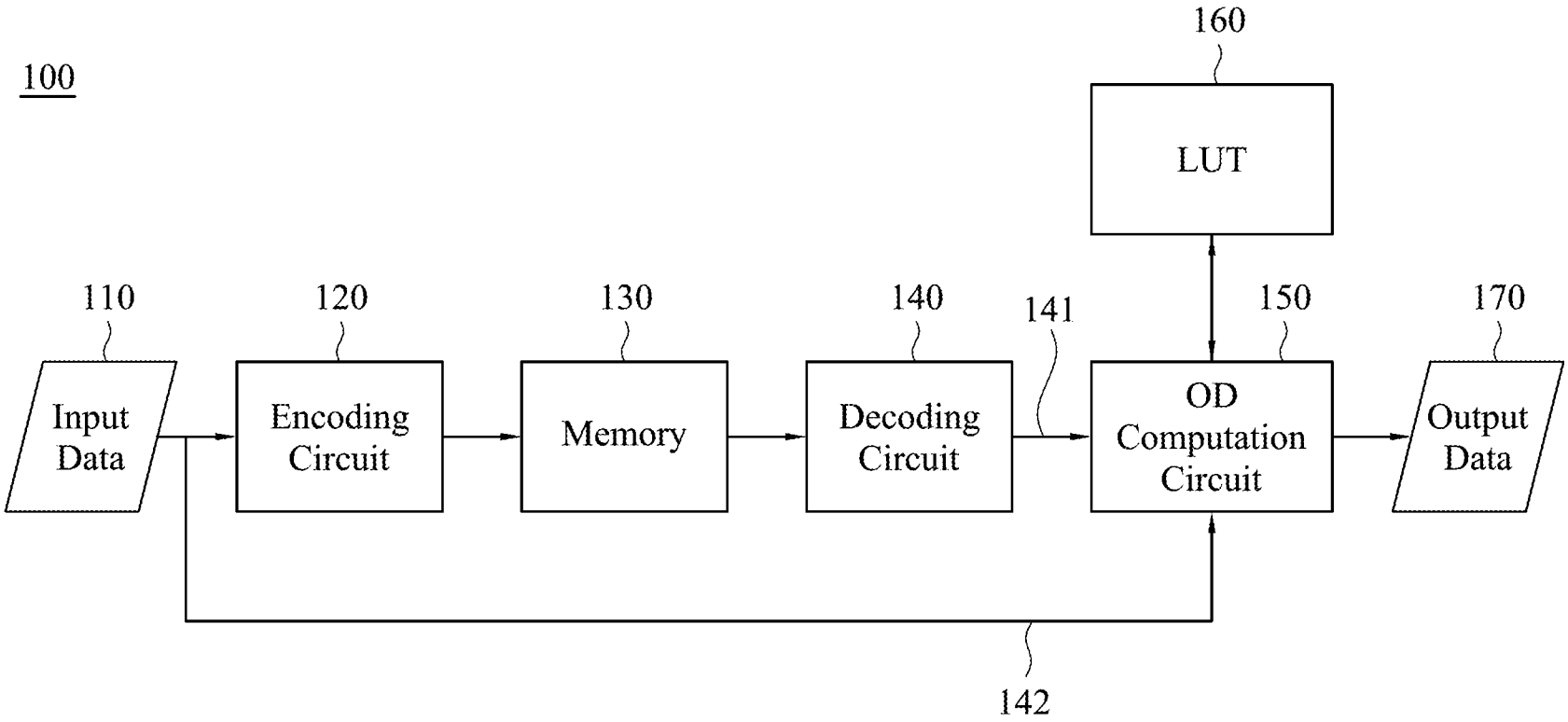
FIG. 1 is a block diagram of an overdrive circuit in accordance with an embodiment.

FIG. 1 is a block diagram of an overdrive circuit in accordance with an embodiment. Referring to FIG. 1, an overdrive circuit 100 includes an encoding circuit 120, a memory 130, a decoding circuit 140, an overdrive (OD) computation circuit 150, and a lookup table (LUT) 160. The memory 130 is electrically connected to the encoding circuit 120 and the decoding circuit 140. The overdrive computation circuit 150 is electrically connected to the decoding circuit 140 and the lookup table 160. The memory 130 may be a volatile memory or a non-volatile memory. A current image and a previous image are required for an OD method, and thus the memory 130 is used to store the previous image. The encoding circuit 120 and the decoding circuit 140 are configured to compress/decode the previous image to reduce required memory space. The overdrive circuit 100 may be disposed in a display panel such as a liquid crystal display panel. In some embodiments, the overdrive circuit 100 is a portion of a time controller.

To be specific, input data 110 includes an input image such as a color image. The encoding circuit 120 performs loss compression to the input image to generate image data. The loss compression is, for example, a JPEG_LS algorithm or any other suitable algorithm which is not limited in the disclosure. The compressed image data is stored into the memory 130. The decoding circuit 140 reads the image data from the memory 130 and decodes the image data to obtain a previous image 141. Note that due to the loss compression algorithm, grey levels at the same X coordinate and Y coordinate of multiple frames in a video may become unsmooth (i.e. different from each other even they are originally identical to each other) after they are compressed and decoded. These unsmooth grey levels may cause flicker after a conventional OD method is performed. In the embodiment, the OD computation circuit 150 performs a progressive overdrive method to address the flicker problem.

To be specific, the OD computation circuit 150 obtains the previous image 141 from the decoding circuit 140 and a current image 142 from the input data 110. The OD computation circuit 150 calculates a difference between a current grey level at a location (including X coordinate and Y coordinate) of the current image 142 and a previous grey level of the previous image 141 at the same location. In the following equations, the current grey level is written as current_value, and the previous grey level is written as previous_value. The difference is calculated based on the following equation (1).

$$D=\text{current_value}-\text{previous_value} \tag{1}$$

The overdrive computation circuit 150 also calculates an overdrive grey level corresponding to the current grey level according to the current grey level and the previous grey level. In some embodiments, the overdrive computation circuit 150 inputs the current grey level and the previous grey level to the lookup table 160 to obtain the overdrive grey level. The values stored in the lookup table may be determined in advance based on the characteristic of the display panel.

If the difference D is greater than or equal to a threshold, the overdrive computation circuit 150 outputs the overdrive grey level as an output grey level to replace the current grey level.

If the difference D is less than the threshold, then a progressive output grey level is generated. To be specific, a gain is calculated according to the difference D and the threshold. In some embodiments, a ratio of the difference D to the threshold is calculated as the following equation (2).

$$x=\frac{D}{T} \tag{2}$$

T is the threshold, and x is the ratio. Next, the ratio x is inputted into a continuous and increasing function to obtain a gain. In some embodiments, the continuous and increasing function may include a linear function, a polynomial function, an exponential function, a logarithmic function or the combination thereof, which is not limited in the disclosure. The polynomial function is taken as an example herein.

Figure 2:
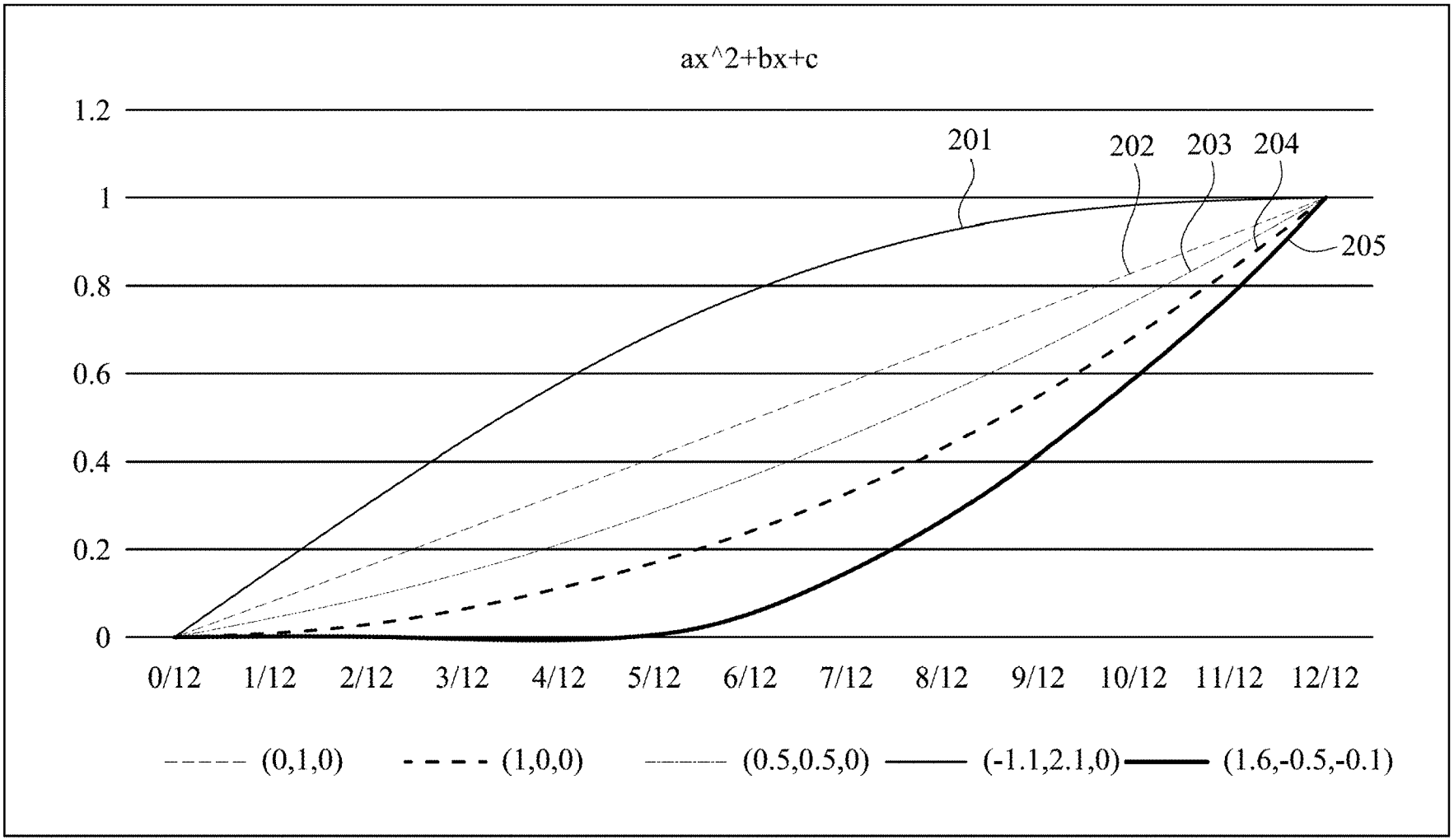
FIG. 2 is a diagram of the polynomial function in accordance with an embodiment.

FIG. 2 is a diagram of the polynomial function in accordance with an embodiment. Referring to FIG. 2, the horizontal axis is the ratio x, and the vertical axis is the gain G. The polynomial function is represented as G=ax^2+bx+c in which a, b, and c are parameters forming a vector (a, b, c). Different vectors correspond to different curves. For example, a curve 201 corresponds to a vector (−1.1, 2.1, 0), a curve 202 corresponds to a vector (0, 1, 0), a curve 203 corresponds to a vector (0.5, 0.5, 0), a curve 204 corresponds to a vector (1, 0, 0), and a curve 205 corresponds to a vector (1.6, −0.5, −0.1). What the curves 201-205 have in common is the when the ratio x is equal to 1, the output of the continuous and increasing function is equal to 1. In the example, the sum of the parameters a, b, and c is equal to 1. In some embodiments, when the ratio x is greater than 1, the gain G is set to be 1.

Figure 3:
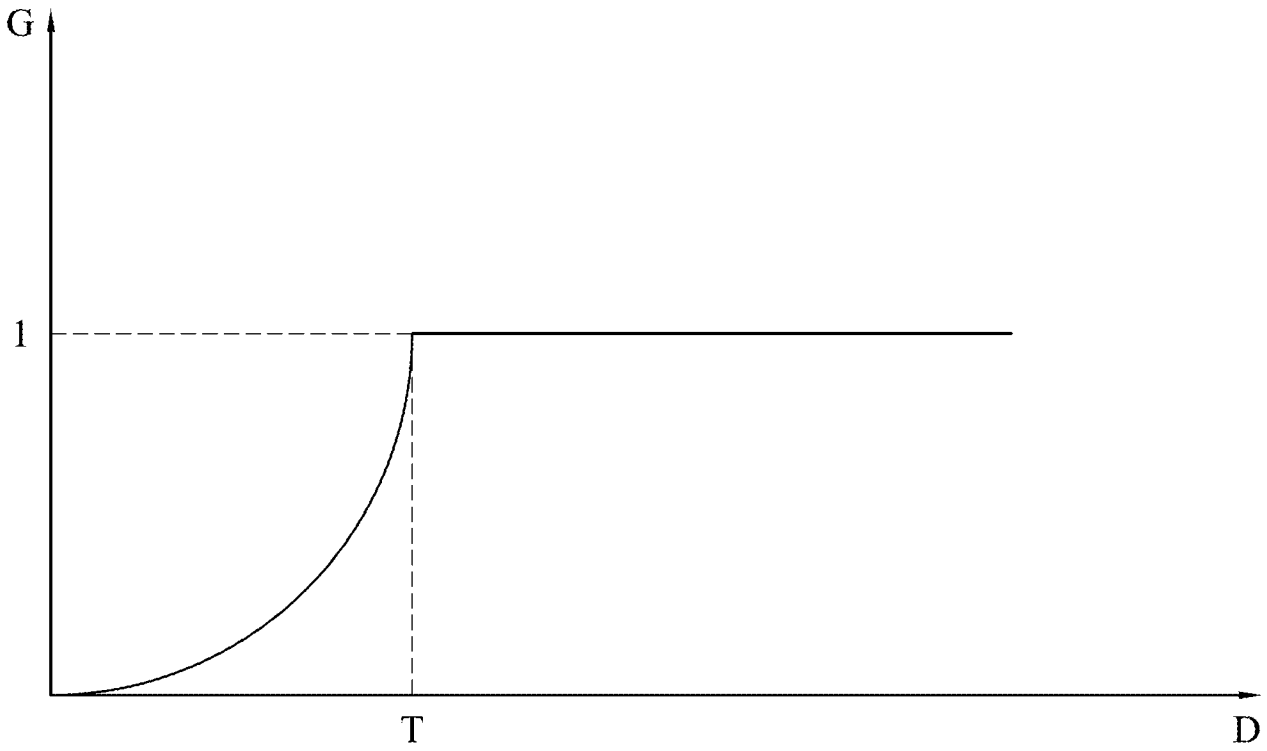
FIG. 3 is a diagram of the gain G with respect to the difference D in accordance with an embodiment.

At last, the overdrive computation circuit 150 mixes the overdrive grey level and the current grey level according to the gain to generate the output grey level to replace the current grey level. In some embodiment, the mixing step is based on the following equation (3).

$$\text{output_value}=\text{current_value}+G\times(\text{OD_value}-\text{current_value}) \tag{3}$$

output_value is the output grey level, OD_value is the overdrive grey level. FIG. 3 is a diagram of the gain G with respect to the difference D in accordance with an embodiment. Referring to FIG. 3 and the equation (3), when the difference D is greater than or equal to the threshold T, the gain G is equal to 1, and therefore the output grey level is equal to the overdrive grey level. When the difference D is in a range from 0 to the threshold T, the gain G is in a range from 0 to 1, and the output grey level is equal to a weighting sum of the overdrive grey level and the current grey level in which G and (1-G) are taken as the weights respectively. Accordingly, the flicker will not occur when the difference D is alternatively greater than the threshold T and less than the threshold T in a video because the generated output grey level is relatively smooth.

Referring to FIG. 1, after calculating all output grey levels for the current image 142, output data 170 is generated.

Figure 4:
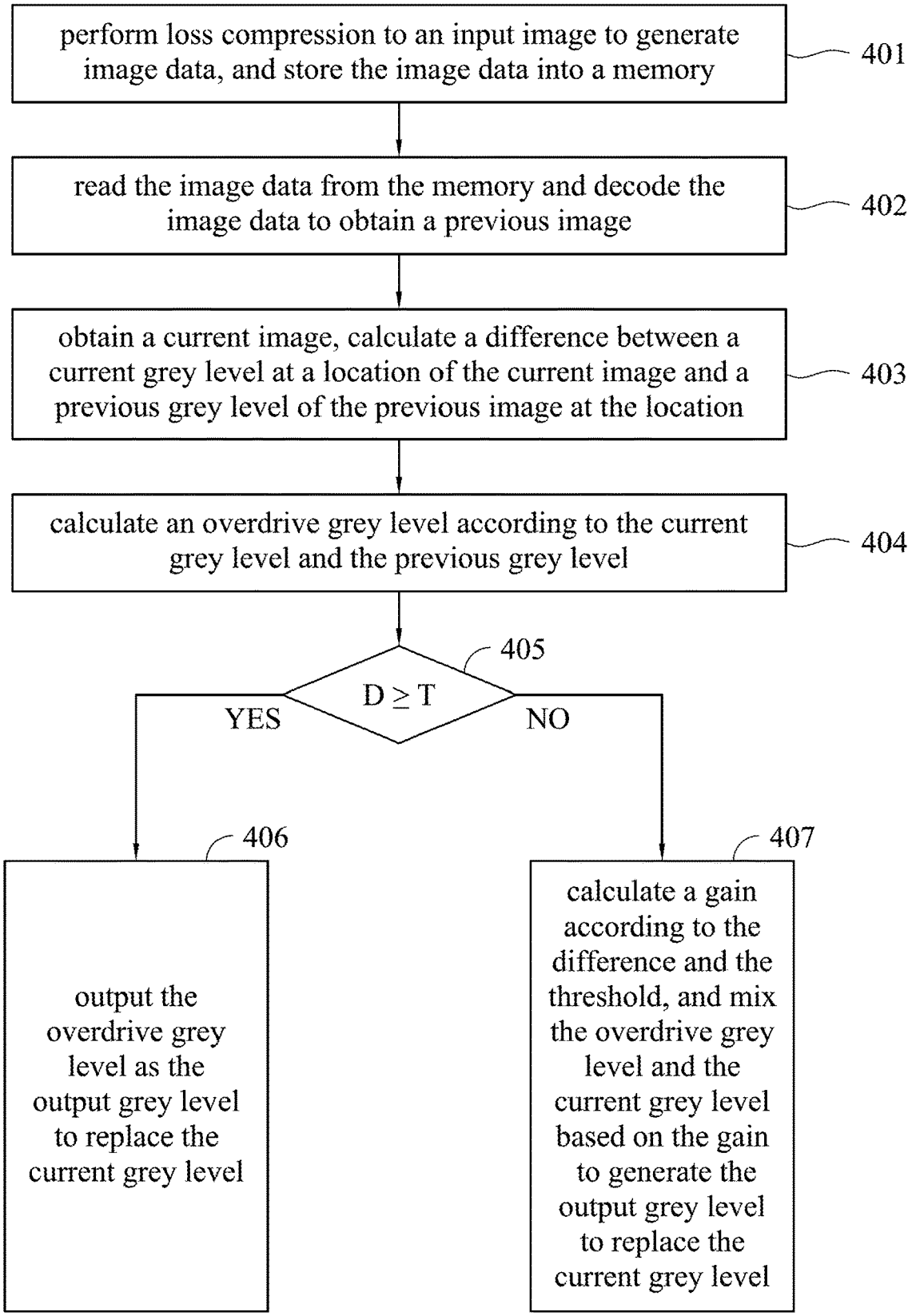
FIG. 4 is a flow chart of an overdrive method in accordance with an embodiment.

FIG. 4 is a flow chart of an overdrive method in accordance with an embodiment. Referring to FIG. 4, in step 401, loss compression is performed to an input image to generate image data, and the image data is stored into a memory. In step 402, the image data is read from the memory and the image data is decoded to obtain a previous image. In step 403, a current image is obtained, and a difference between a current grey level at a location of the current image and a previous grey level of the previous image at the location is calculated. In step 404, an overdrive grey level is calculated according to the current grey level and the previous grey level. In step 405, whether the difference D is greater than or equal to a threshold T is determined. If the result is "Yes", in step 406, the overdrive grey level is outputted as the output grey level to replace the current grey level. If the result of the step 405 is "No", in step 407, a gain is calculated according to the difference and the threshold, the overdrive grey level and the current grey level is mixed based on the gain to generate the output grey level to replace the current grey level. However, all the steps in FIG. 4 have been described in detail above, and therefore the description will not be repeated. Note that the step 404 may be performed after the step 405 and before the step 406 or the step 407. In some embodiments, the steps 405 and 406 may be omitted. The steps in FIG. 4 can be implemented as program codes or circuits that are not limited in the disclosure. In addition, the method in FIG. 4 can be performed with the aforementioned embodiments, or can be performed independently. In other words, other steps may be inserted between the steps of the FIG. 4.

In the aforementioned overdrive circuit and method, the current grey level is altered progressively based on the difference between the current grey level and the previous grey level, and thus the flicker phenomenon will not occur.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An overdrive method for a display panel, the overdrive method comprising:

performing loss compression to an input image to generate image data, and storing the image data into a memory;

reading the image data from the memory and decoding the image data to obtain a previous image;

obtaining a current image, calculating a difference between a current grey level at a location of the current image and a previous grey level of the previous image at the location;

calculating an overdrive grey level according to the current grey level and the previous grey level;

if the difference is less than a threshold, calculating a gain according to the difference and the threshold, and mixing the overdrive grey level and the current grey level based on a following equation to generate an output grey level to replace the current grey level:

$$output_value = current_value + G \times (OD_value - current_value)$$

wherein output_value is the output grey level, current_value is the current grey level, OD_value is the overdrive grey level, and G is the gain; and if the difference is greater than or equal to the threshold, outputting the overdrive grey level as the output grey level to replace the current grey level.

2. The overdrive method of claim 1, wherein calculating the gain according to the difference and the threshold comprises:

calculating a ratio of the difference to the threshold; and inputting the ratio into a continuous and increasing function to obtain the gain.

3. The overdrive method of claim 2, wherein the continuous and increasing function is a polynomial function.

4. The overdrive method of claim 1, wherein calculating the overdrive grey level according to the current grey level and the previous grey level comprises:

inputting the current grey level and the previous grey level to a lookup table to obtain the overdrive grey level.

5. An overdrive circuit comprising:

a memory;

an encoding circuit electrically connected to the memory and configured to perform loss compression to an input image to generate image data, and to store the image data into the memory;

a decoding circuit electrically connected to the memory and configured to read the image data from the memory and to decode the image data to obtain a previous image; and an overdrive computation circuit electrically connected to the decoding circuit and configured to obtain a current image, calculate a difference between a current grey level at a location of the current image and a previous grey level of the previous image at the location, and calculate an overdrive grey level according to the current grey level and the previous grey level, wherein if the difference is less than a threshold, the overdrive computation circuit is configured to calculate a gain according to the difference and the threshold, and mix the overdrive grey level and the current grey level based on a following equation to generate an output grey level to replace the current grey level:

$$output_value = current_value + G \times (OD_value - current_value)$$

wherein output_value is the output grey level, current_value is the current grey level, OD_value is the overdrive grey level, and G is the gain, wherein if the difference is greater than or equal to the threshold, the overdrive computation circuit is configured to output the overdrive grey level as the output grey level to replace the current grey level.

6. The overdrive circuit of claim 5, wherein the overdrive computation circuit is further configured to calculate a ratio of the difference to the threshold and input the ratio into a continuous and increasing function to obtain the gain.

7. The overdrive circuit of claim 6, wherein the continuous and increasing function is a polynomial function.

8. The overdrive circuit of claim 5, wherein the overdrive computation circuit is further configured to input the current grey level and the previous grey level to a lookup table to obtain the overdrive grey level.

* * * * *